US005388706A

United States Patent [19]

Baldur

[11] Patent Number: 5,388,706

[45] Date of Patent: Feb. 14, 1995

[54] APPARATUS FOR IDENTIFYING AND SORTING DIFFERENT TYPES OF A CLASS OF ARTICLES

[75] Inventor: Roman Baldur, Baie d'Urfe, Canada

[73] Assignee: Walsh Automation Inc., Montreal, Canada

[21] Appl. No.: 148,594

[22] Filed: Nov. 8, 1993

[51] Int. Cl.[6] ..... B07C 5/00

[52] U.S. Cl. ..... 209/587; 209/939

[58] Field of Search ..... 209/559, 563, 598, 587, 209/939

[56] References Cited

U.S. PATENT DOCUMENTS

| | | | |
|---|---|---|---|
| 2,821,302 | 1/1958 | Fowler et al. | 209/587 |
| 3,581,887 | 6/1971 | Radutsky | 209/125 |
| 4,414,566 | 11/1983 | Peyton et al. | 358/101 |
| 4,450,073 | 5/1984 | Burnett | 209/564 |
| 4,586,613 | 5/1986 | Horii | 209/587 |
| 4,610,359 | 9/1986 | Muller | 209/939 |
| 5,020,675 | 6/1991 | Cowlin et al. | 209/939 |

*Primary Examiner*—Kenneth W. Noland
*Attorney, Agent, or Firm*—Fishman, Dionne & Cantor

[57] ABSTRACT

An elevated, closed loop, conveyor arrangement defines a closed loop conveyor path, and a plurality of carriers are operatively connected to the conveyor means for movement around the path. At least one loading station is located on the path, and an identification station, disposed after the loading station in the direction of movement of the carrier means, is also located on the path. A plurality of unloading stations are located on the path after the identification station in the direction of movement of the carrier, and each unloading station receives a different type of the class of articles so that only one type of the class of articles is unloaded at each unloading station. In operation, a single article of the class is mounted on each carrier at the loading station. The type of each article is identified at the identification station, and each article is unloaded at the unloading station for receiving the type of article identified at the identification station. The articles rest on the carriers without clamps, and the carriers are so constructed that they do not provide an obstruction between the cameras and the articles at different camera angles.

7 Claims, 7 Drawing Sheets

APPARATUS FOR IDENTIFYING AND SORTING DIFFERENT TYPES OF A CLASS OF ARTICLES

BACKGROUND OF INVENTION

1. Field of the Invention

The invention relates to an apparatus for identifying and sorting different types of a class of article. More specifically, the invention relates to such an apparatus which requires only a single conveyor arrangement, both the identifying and the sorting process being carried out on the single conveyor arrangement.

In a particular embodiment, the apparatus is used to automatically identify and sort different models of used brake shoes.

2. Description of Prior Art

Brake shoe sorters for sorting used brake shoes are known in the art as illustrated in, for example, a brochure entitled, Conklin Model 3000 Brake Shoe Sorter (undated) and Automotive Brake Shoe Sorting System, Society of Manufacturing Engineers, November 1990, Document MS9-582, Baldur et al. The apparatus as described in both of these documents includes an identification section and a physically separate sorting section. The identification section in the Baldur et al article is illustrated in FIG. 2 and identified as the Inspection Phase. The identifying section in Conklin is used together with an index wheel and the description of the index wheels provides an adequate explanation of the identification process in the Conklin apparatus. In the apparatus of both cases, once the brake shoe is identified, it is transferred to a sorting conveyor which is illustrated in the Conklin brochure and identified as such. In Baldur et al, it is once again illustrated at FIG. 2 where there is shown a transfer conveyor for transferring a brake shoe from the identification section to the sorting section.

It is also quite clear from the description of the apparatus in both Conklin and Baldur et al that each brake shoe has to be stopped at different points in the identification section to obtain identifying data.

The need to stop at different places in the identifying process, and the need to provide two separate sections, one for identification and one for sorting, limits both the size and speed of operation of these brake shoe sorting apparatuses of the prior art.

Other sorting apparatuses are also known in the prior art as illustrated in, for example, U.S. Pat. Nos., 3,581,887, Radutsky, Jun. 1, 1971, 4,414,566, Peyton et al, Nov. 8, 1983, 4,450,073, Burnett et al, May 22, 1984, 4,610,359, Müller, Sep. 9, 1986 and 5,020,675, Cowlin et al, Jun. 4, 1991.

The Radutsky and Burnett et al patents teach elevated conveyor systems including a chain drive. However, as can be seen, the conveyor systems of these patents are used for entirely different purposes than the purposes as contemplated herein. Thus, the Radutsky system is used in a plant for sorting washing in laundries. The Burnett et al system is used for weight grading and sorting. Burnett et al also teaches a plurality of tippable cups at different positions on its conveyor, and the cups are selectively tipped at certain positions based on the weight of the contents in the cup.

The apparatus of Peyton et al is used to sort and inspect bottles. As seen in FIGS. 1 and 2, the Peyton et al system includes a camera 42 for obtaining visual data concerning the bottles to be inspected and sorted. The data obtained by the camera is processed in a CPU 50.

The sorting apparatus in Müller includes an endless belt conveyor. Data for sorting is obtained from an optical electronic sensor 18. The data is provided to an evaluation device 13 which automatically ejects appropriate articles at different ejection stations described at column 3, lines 45 et seq of the patent. It would appear that, in accordance with the teachings of Müller, data is obtained "on the fly".

Cowlin et al teaches a sorting apparatus which uses a camera 33 for scanning moving articles. Once again, it would appear that the scanning is done without stopping the conveyor belt which moves the articles through an inspection region. The Cowlin et al patent also teaches means for ejecting articles at different locations depending on their characteristics.

SUMMARY OF INVENTION

It is an object of the invention to provide an apparatus for identifying and sorting different types of a class of article which overcomes the problems of the Prior Art.

It is a more specific object of the invention to provide such an apparatus which requires only a single conveyor arrangement, both the identifying and the sorting process being carried out on the single conveyor arrangement.

In accordance with a broad aspect of the invention, the apparatus includes means for identifying a plurality of different types of a class of article, a plurality of unloading stations, means for distributing the articles and unloading each type of article at a respective one of the unloading stations, whereby to sort the articles so that only one type of article is unloaded at each unloading station.

It is also an object of the invention to provide an apparatus for identifying and sorting different models of brake shoes which overcomes the problems of the prior art.

It is a more specific object of the invention to provide such an apparatus which requires only a single conveyor arrangement, both the identifying and the sorting process being carried out on the single conveyor arrangement.

In accordance with a broad aspect of this invention, the apparatus includes means for identifying a plurality of different models of brake shoe, a plurality of unloading stations, means for distributing the brake shoes and unloading each model of brake shoe at a respective one of the unloading stations, whereby to sort the brake shoes so that only one model of brake shoe is unloaded at each unloading station.

In accordance with a particular embodiment of the invention there is provided an apparatus for identifying and sorting different types of a class of articles, comprising:

an elevated, closed loop, conveyor arrangement defining a closed loop conveyor path;

a plurality of carrier means operatively connected to said conveyor means for movement around said path;

at least one loading station located on said path;

an identification station located on said path after said loading station in the direction of movement of said carrier means;

a plurality of unloading stations located on said path after said identification station in the direction of movement of said carrier means, each unloading station receiving a different type of said class of articles, whereby only one type of said class of articles is unloaded at each unloading station;

wherein, a single article of said class is mounted on each carrier means at said loading station;

the type of each article is identified at said identification station; and each article is unloaded at said unloading station for receiving the type of article identified at said identification station.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
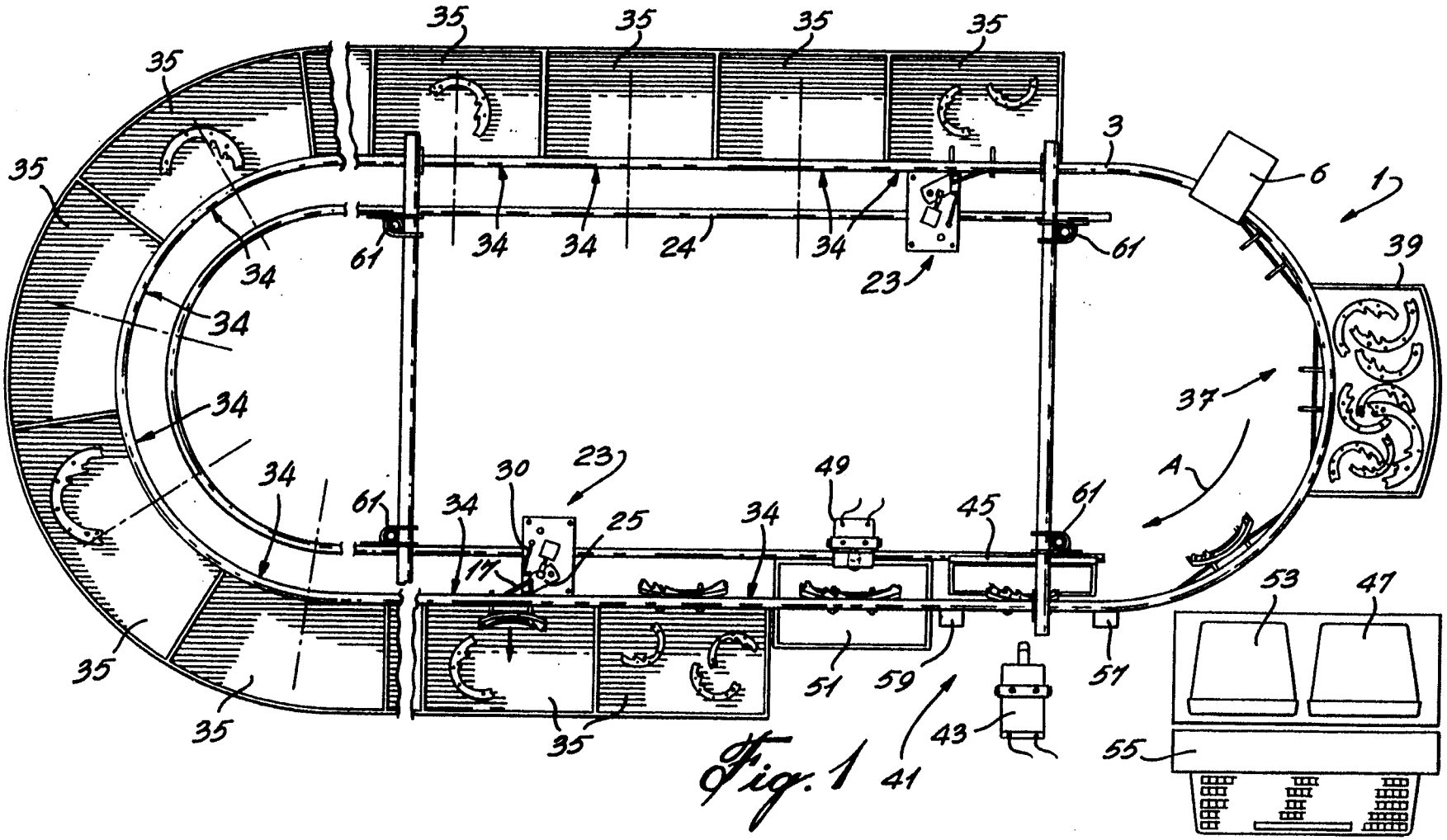
FIG. 1 is a top view of an apparatus in accordance with the invention.
Figure 2:
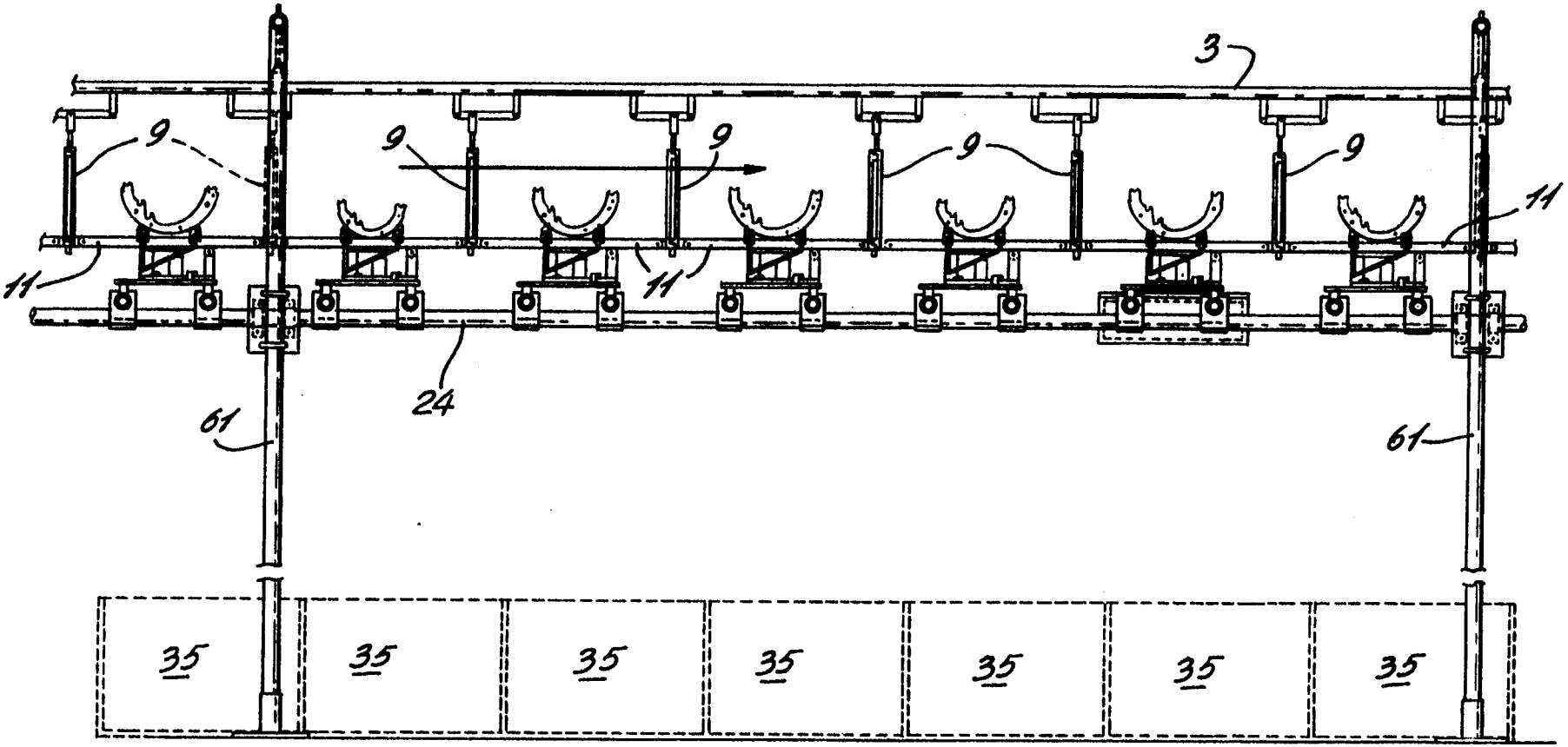
FIG. 2 is a side view of the apparatus of FIG. 1.
Figure 3:
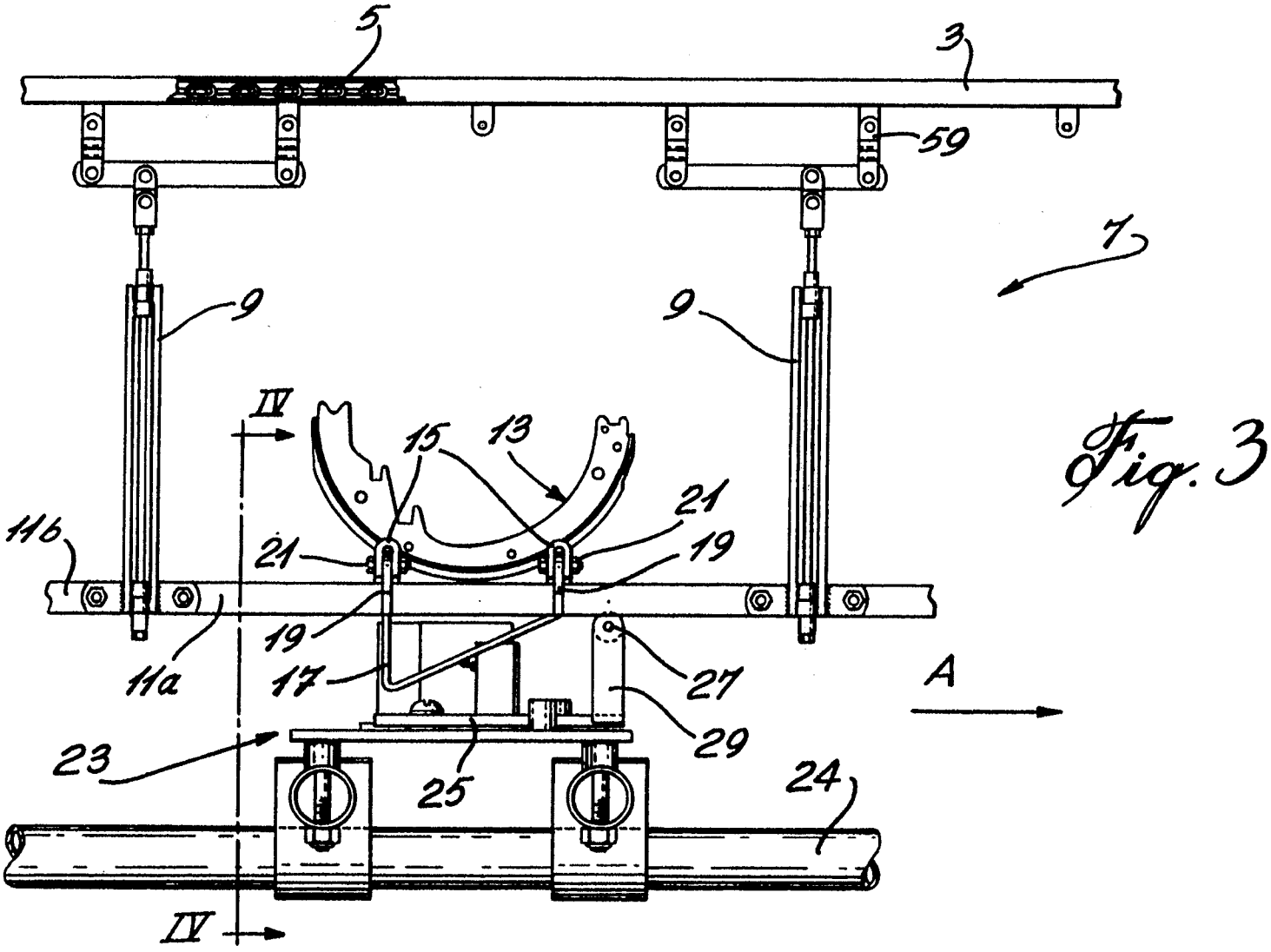
FIG. 3 illustrates a single carrier.

Referring to FIGS. 1, 2 and 3, the apparatus of the invention includes a conveying arrangement, illustrated generally at 1, and including a closed loop upper rail 3. The upper rail 3 is a hollow member and, as seen in FIG. 3, a chain 5 extends through the interior part of the upper rail 3. The chain 5 also forms a closed loop.

A motor, illustrated schematically at 6 in FIG. 1, drives the chain along a conveyor path which conveyor path is defined by the closed loop upper rail 3.

Figure 5:
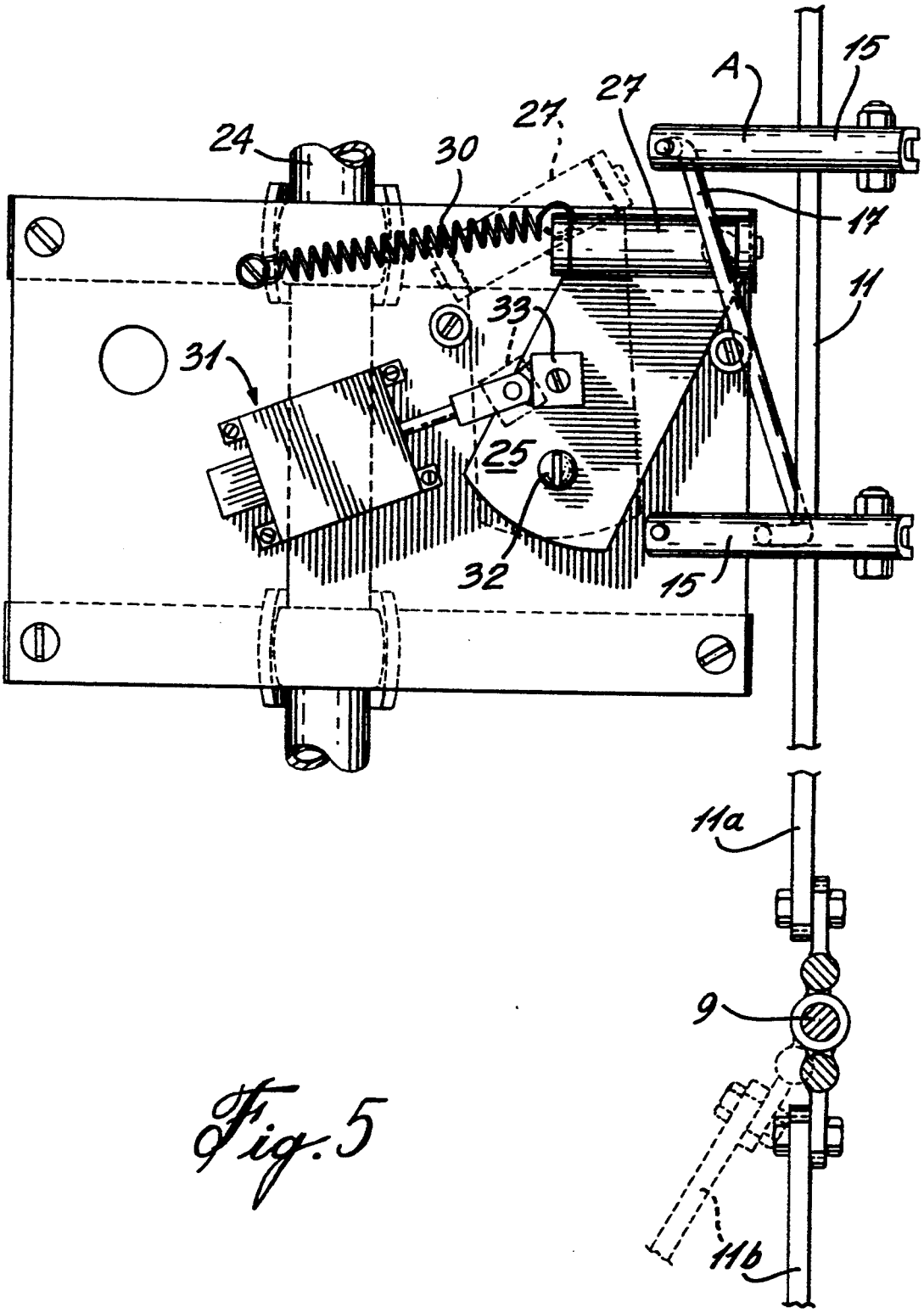
FIG. 5 is a top view of the cam tripper.

As also seen in FIGS. 2 and 3, the chain 5 supports carriers 7. A single carrier is illustrated in FIG. 3, however, as seen in FIG. 2, there are a plurality of carriers which are distributed along the closed loop conveyor path defined by the rail 3. Each carrier includes vertical suspension means 9, which are attached to the chain 5, and a horizontal bar 11, which is attached to the bottom ends of the vertical suspension means 9. Preferably, the carriers are connected to each other by their horizontal bars 11 to also form a closed loop around the conveyor path. The carriers are preferably connected to each other by connecting adjacent horizontal bars 11 of the carriers to each other. As seen in FIGS. 3 and 5, horizontal bar 11*a* is connected to a horizontal bar 11*b* so that the horizontal bars are pivotable relative to each other whereby the carriers can traverse an annular path.

As seen in FIG. 3, brake shoes 13 are carried on support members which, in FIG. 3, are shown as saddle members 15. As seen in FIG. 5, the saddle members are elongated members which extend traversely to the conveyor path.

Figure 4:
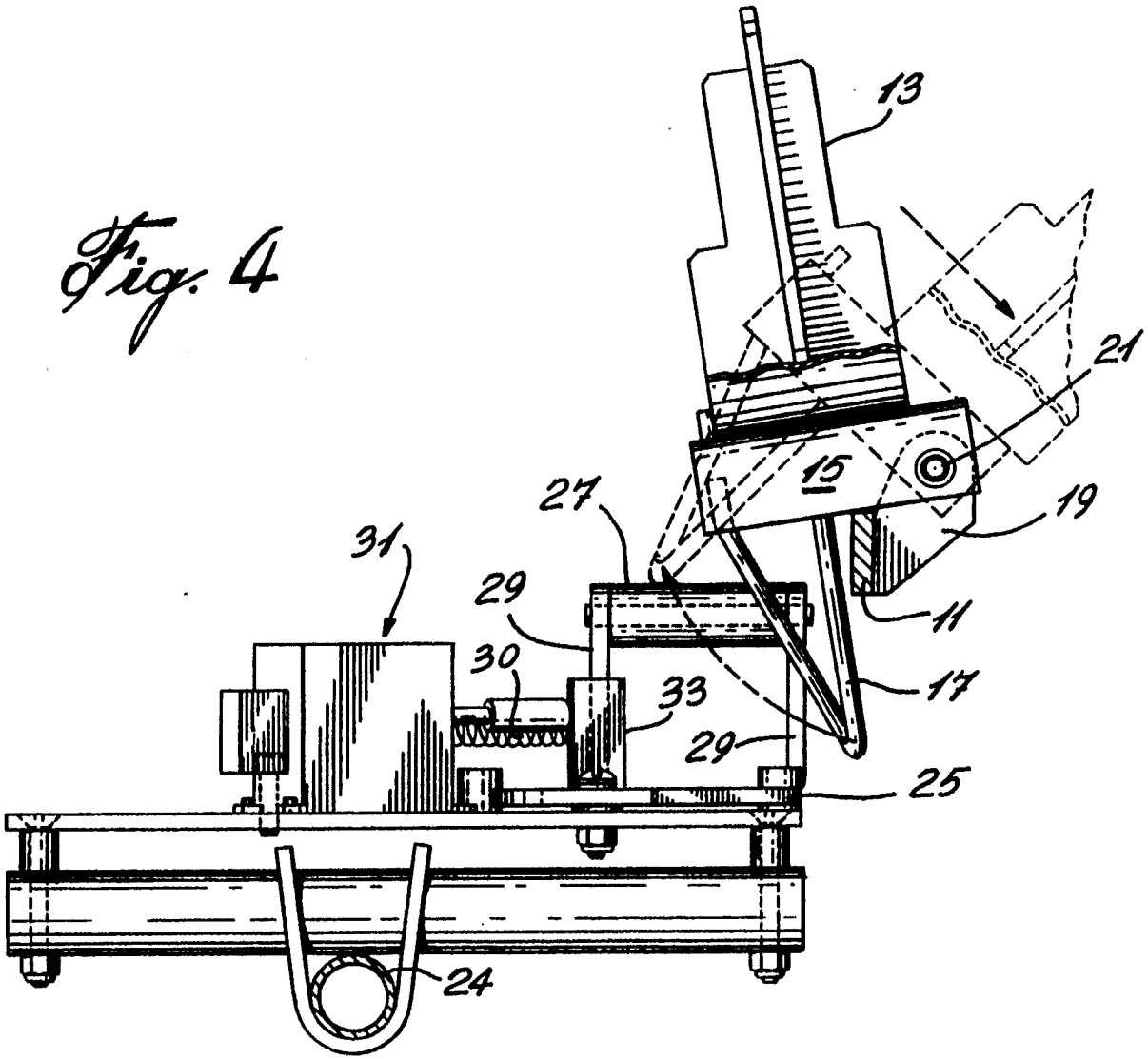
FIG. 4 is a front view illustrating how the cam is tripped by the cam tripper.

As seen in FIGS. 3, 4 and 5, a cam member 17 is connected to the saddle members 15. The cam member 17 is a wire-like member which extends from one saddle member to the other at an angle to the horizontal.

As seen in FIG. 3 and 4, connecting flange 19 connects saddle member 15 to bar 11. The saddle member is connected to the rail to pivot about point 21 for reasons to be discussed below. Although only a single flange is illustrated in FIG. 4, it will be understood that each saddle member is connected by its own flange 19 to the bar 11 as shown in FIG. 3.

As seen in FIGS. 1 to 5, a cam tripper arrangement 23 is mounted on rail 24 which rail is enclosed by the rail 3, as shown in FIG. 1, and underlies the rail 3 as shown in FIGS. 2 and 3. The cam tripper arrangement 23 includes a pivotable table 25 which mounts roller 27, on vertical arms 29. The table is maintained in its rest position, shown in dotted lines in FIG. 5, by spring 30. It is moved into its operating position by solenoid 31. The end of solenoid 31 is connected, by 33, to the table 25 for pivoting the table 25 about the point 32. When the table is in the position shown in solid lines in FIG. 4, then roller 27 is in its operating position as will be described below.

Returning again to FIGS. 1 and 2, disposed around the conveyor path, and the rail 3, are unloading stations 34. Disposed at each unloading station is a bin 35. The bin 35 is disposed on the floor around the rail 3. The rail 3 is maintained in an elevated position either from the ceiling or with vertical rods 61 extending from the floor 100 to the rail 3 as shown in FIG. 2. The manner of maintaining the rail 3 in an elevated position above the floor 100 is well known and requires no further description at this time.

A separate cam tripper arrangement 23 is disposed at each unloading station 34 although only two such cam tripper arrangements are illustrated in FIG. 1.

At least one loading station 37, disposed at one end of the conveyor path, has an underlying bin 39 filled with brake shoes. As a carrier arrangement 7, as illustrated in FIG. 3, passes the loading station, a human loader will load one of the brake shoes onto the saddle members 15 of the carrier 7.

Figure 6:
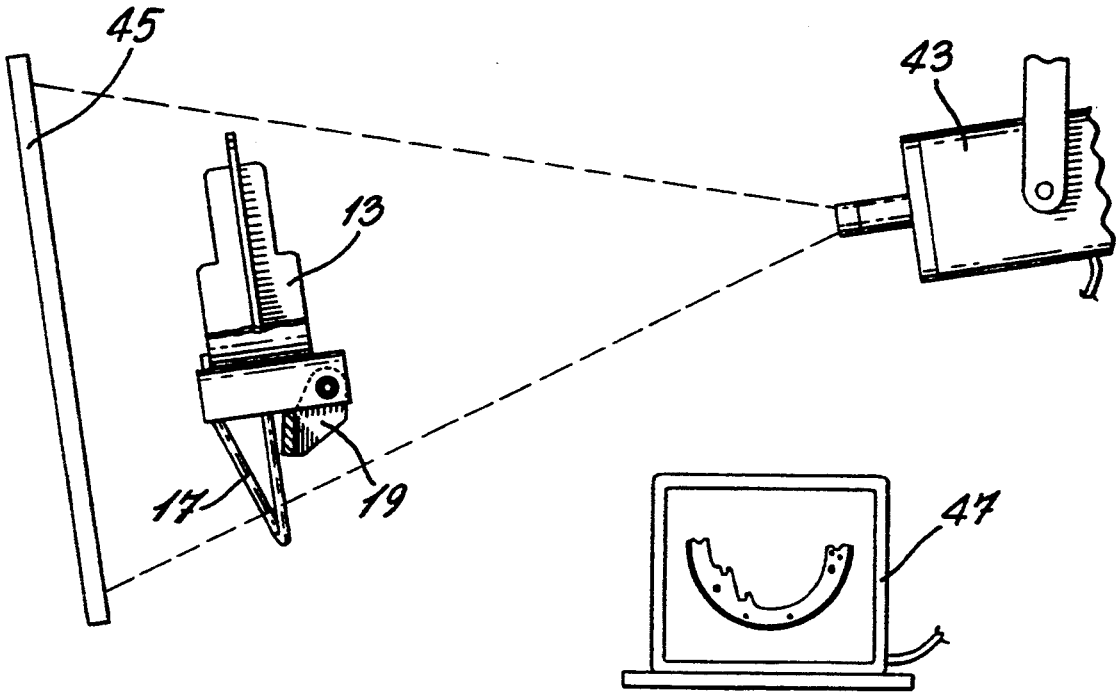
FIG. 6 illustrates the side camera.
Figure 7:
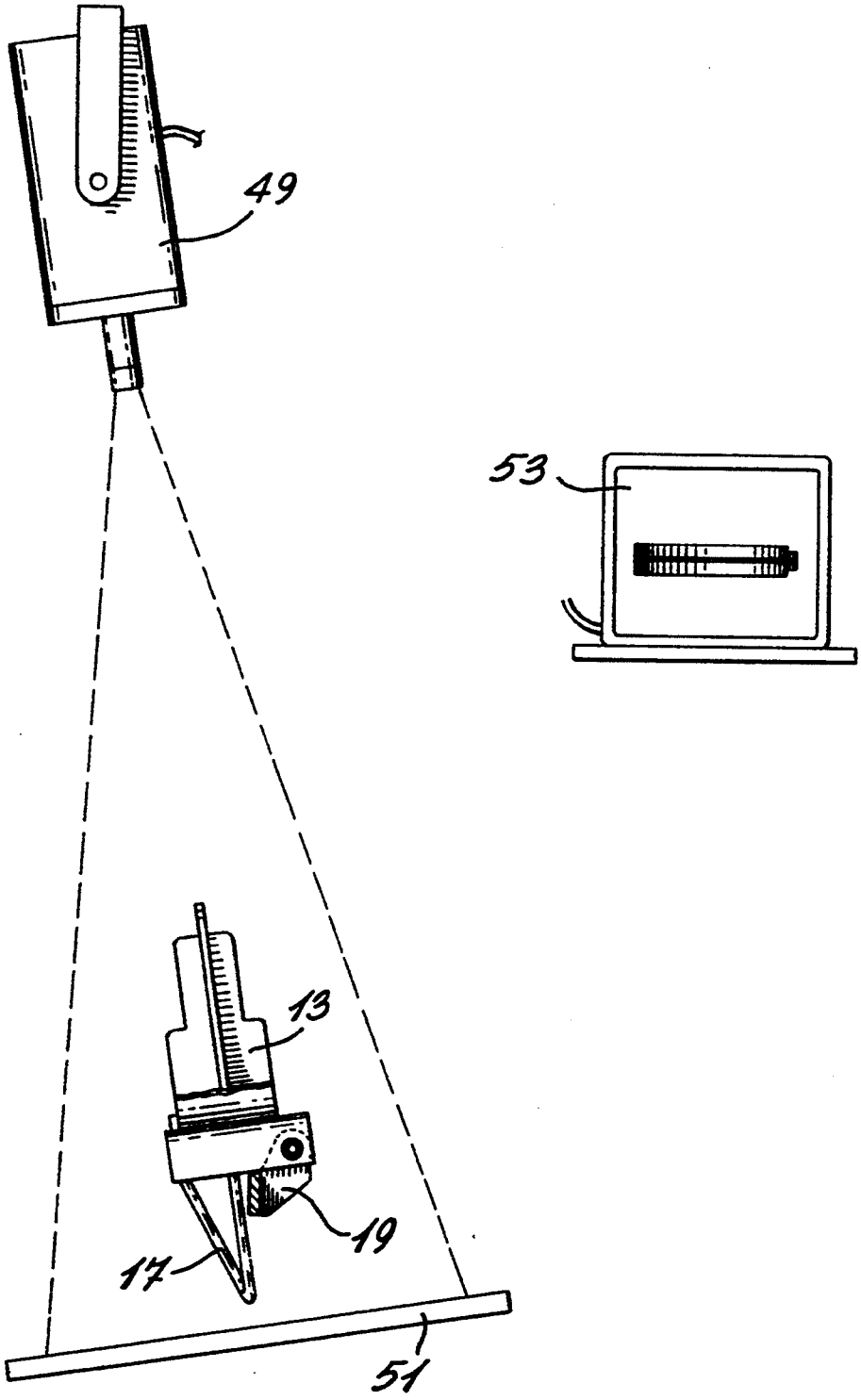
FIG. 7 illustrates the top camera.

An identification station 41, which includes a horizontal camera 43 and a vertical camera 49, also includes a vertical screen 45 and a horizontal screen 51 (see FIGS. 6 and 7). A side display unit 47 provides a visual display of the side of the brake shoe, as shown in FIG. 6, and a top display unit 53 shows a top view of the brake shoe as shown in FIG. 7.

A processor 55 has inputs connected to the outputs of cameras 43 and 49. In addition, the processor has a separate output connected to each one of the solenoid arrangements 31 of the cam tripper arrangements 23.

Each unloading position 34 is for unloading a different model of the brake shoes, and each bin 35 is for receiving the model of brake shoe unloaded at its position 34. The processor 55 is instructed, by software, as to the identity of the model type to be unloaded at each of the positions, and which solenoid arrangement should be activated to unload each particular model.

In operation, when the motor 6 is turned on, the chain 5 is driven, in the interior of the rail 3, around the closed loop conveyor path in the direction of arrow A. The chain carries with it the plurality of carriers 7 mounted thereon.

As a carrier 7 arrives at a loading station 37, a loader takes one of the brake shoes out of the bin 39 and places it on the saddle members 15 of the carrier 7 which is passing the loading station. Each empty carrier which passes the loading station is loaded in this manner.

The carrier then approaches the identification station 41, in the direction of the arrow A, until the brake shoe on the carrier is in front of the camera 43. The identification station 41 is, of course, after the loading station 37 in the direction of travel of the conveyor system, i.e. the direction of arrow A. At that point, a picture of the side of the brake shoe will be taken. For this purpose, a switch or the like 57, shown schematically in FIG. 1, could be activated by, for example, bar 59 of the carrier, shown in FIG. 2. The activation of the switch 57 will provide the correct timing for the taking of the picture.

It will be noted that the pictures are taken without arresting the motion of the chain 5 or its carrier.

The carrier will then continue along the direction of the arrow A until it is under the camera 49. A picture will then be taken of the top of the brake shoe. For this purpose, the switch, illustrated schematically at 59, could be activated to provide a timing signal for activating camera 49.

Data from cameras 43 and 49 is provided to the processor 55 which analyzes the data to determine specific predetermined characteristics of the side view and the top view of each brake shoe. These characteristics are then compared with characteristics in a look up table stored in the processor so that the model of the shoe brake which is passing the cameras is determined.

The processor has, within its memory, the address of the unloading position for that particular model. The processor is also able to calculate the time at which the carrier carrying the particular model will arrive at its unloading station. The processor will then send an actuating signal to the solenoid 31 at the appropriate loading station so that the cam tripper at that loading station will be actuated at the time that the carrier arrives at that station with the particular model of brake shoe.

With the table 25 in its rest position, roller 27 will not be in the path of the cam 17 as seen in FIG. 5. However, as seen in the same figure, when the table 25 is in its operating position (solid lines) roller 27 will be in the path of cam 17 so that cam 17 will ride up along the roller and the saddle arrangement will be caused to tilt as shown in FIG. 4. The brake shoe will then fall off the saddle arrangement and into the bin 35 at the particular unloading station. Accordingly, the apparatus automatically identifies and sorts the brake shoes by distributing them to preselected loading stations.

The support members, which are shown in the drawings as saddle members 15, must provide a minimum but sufficient support for the brake shoes and at the same time provide maximum visibility so that the cameras will not be blocked, by the support members, from taking different views of the brake shoes. It is also necessary that the brake shoes lie freely on the support and that there are no clamps whereby the loading of the brake shoes on the support members is simplified and, once again, the support members do not block the camera for being able to record all pertinent data of the brake shoes.

The reason for requiring a minimum of support is so that, when the support member is tilted to unload the brake shoe, there will be nothing to impede this unloading step.

Although the above description has illustrated how the apparatus could be used to sort brake shoes, it will be obvious that the apparatus could be used to sort other classes of articles wherein there exist different types of this class of article. In addition, although a particular type of ejection mechanism has been illustrated, it will be obvious that other types of mechanisms could be used for unloading brake shoes at the unloading stations. In addition, different moving means could be used to move the carriers around the closed loop conveyor path.

Although a particular embodiment has been described, this was for the purpose of illustrating, but not limiting, the invention. Various modifications, which will come readily to the mind of one skilled in the art, are within the scope of the invention as defined in the appended claims.

I claim:

1. Apparatus for identifying and sorting different types of a class of articles, comprising:

an elevated, closed loop, conveyor arrangement defining a closed loop conveyor path;

a plurality of carrier means operatively connected to said conveyor means for movement around said path;

at least one loading station located on said path;

an identification station located on said path after said loading station in the direction of movement of said carrier means;

a plurality of unloading stations located on said path after said identification station in the direction of movement of said carrier means, each unloading station receiving a different type of said class of articles, whereby only one type of said class of articles is unloaded at each unloading station;

wherein, a single article of said class is mounted on each carrier means at said loading station;

the type of each article is identified at said identification station; and each article is unloaded at said unloading station for receiving the type of article identified at said identification station;

and wherein said identification station comprises a means for making an identification;

and wherein each said unloading station comprises means for unloading;

and further including processor means;

said means for making an identification being connected to said processor means to provide said processor means of identification data;

said processor means analyzing said identification data whereby to determine the type of said article;

said processor means being connected to each said means for unloading to provide a signal for effecting unloading at each said unloading station;

said processor means being programmed to, after identifying the type of an article, determine which unloading station that article should be unloaded at, and when a signal should be sent to that station to unload that article;

said identification means comprising a plurality of video camera means for recording different views of said articles;

said video camera means comprising a side view camera for recording side view characteristics of said articles and a top view camera, for recording top view characteristics of said articles;

said conveyor arrangement comprising a closed loop hollow rail;

a moveable means mounted in said rail for moving through said rail;

means for driving said moveable means around said closed loop;

and wherein each said carrier means comprises two spaced vertical suspension members;

a horizontal member extending between said vertical suspension members adjacent the bottom end thereof.

2. Apparatus as defined in claim 1 wherein said horizontal members of adjacent carriers are pivotably connected to each other;

whereby said carrier means can traverse an annular path.

3. Apparatus as defined in claim 2 wherein support members are provided on each said horizontal member for supporting an article thereon, said support members providing minimum but sufficient support for supporting the articles and maximum visibility to permit said camera means to record said articles fully;

said articles being freely carried on said support member;

whereby, said articles are easily loaded on said carrier means at said loading station and wherein said articles are easily unloaded from said carrier means at appropriate ones of said unloading stations.

4. Apparatus as defined in claim 3 wherein two spaced saddle members are mounted on each said horizontal member;

cam means underlying and connected to said saddle members.

5. Apparatus as defined in claim 4 wherein said means for unloading comprises a cam engagement means at each said unloading station;

said cam engagement means being normally disposed in a rest position wherein said cam engagement means does not engage the cams connected to said saddle members;

means for moving said cam engagement means into an operating position wherein said cam engagement means will engage said cam;

said cam engagement means being moved into said operating position upon receipt of a signal from said processor;

whereby, when said cam engagement means engages said cam, said saddle will be tilted to thereby unload said article.

6. Apparatus as defined in claim 5 and including bins at each unloading station for collecting articles unloaded at that station.

7. Apparatus as defined in claim 6 wherein said class of articles comprises brake shoes and wherein said different types of said classes of articles comprises different models of said brake shoes.

* * * * *